US007458308B2

(12) United States Patent
Badia

(10) Patent No.: US 7,458,308 B2
(45) Date of Patent: Dec. 2, 2008

(54) MULTISTAGED TELESCOPE BOOM

(75) Inventor: José María Badia, Zaragoza (ES)

(73) Assignee: Cargotec Patenter AB, Ljungby (SE)

( * ) Notice: Subject to any disclaimer, the term of this patent is extended or adjusted under 35 U.S.C. 154(b) by 228 days.

(21) Appl. No.: 11/397,004

(22) Filed: Apr. 3, 2006

(65) Prior Publication Data

US 2006/0249469 A1 Nov. 9, 2006

(30) Foreign Application Priority Data

Apr. 1, 2005 (EP) ..... 05102606

(51) Int. Cl.
*F01L 15/00* (2006.01)
*F15B 13/02* (2006.01)

(52) U.S. Cl. ..... 91/189 A; 91/520

(58) Field of Classification Search ..... 91/189 R, 91/189 A, 508, 520; 92/110, 111
See application file for complete search history.

(56) References Cited

U.S. PATENT DOCUMENTS 5,355,769 A * 10/1994 Kottke ..... 91/189 A
5,501,346 A * 3/1996 Wimmer ..... 212/349
6,536,325 B2 * 3/2003 Badia Ba ..... 91/189 A

FOREIGN PATENT DOCUMENTS

| | | |
|---|---|---|
| EP | 1172321 | 1/2002 |
| WO | 96/41764 | 12/1996 |
| WO | 02/093055 | 11/2002 |

* cited by examiner

*Primary Examiner*—Michael Leslie
(74) *Attorney, Agent, or Firm*—Dilworth & Barrese, LLP

(57) ABSTRACT

A multistaged telescope boom, where a hydraulic unit, comprising a piston and a cylinder, is arranged between successive, telescopic arms, comprises a hydraulic system connecting to said hydraulic units for the operation thereof and which is designed to force the hydraulic units of at least the two innermost arms for filling a cylinder chamber of one of these cylinders (9, 10) at the time starting from that of the innermost arm and outwardly in the order of the arms when extending the boom and draining said cylinder chambers in the opposite order when retracting the boom. At least the hydraulic unit of said innermost arm is provided with an arrangement adapted to isolate the cylinder chamber of that first cylinder from communication with said hydraulic system when the cylinder is fully extended and re-establish said communication upon fully retraction of the cylinder next to said first cylinder.

27 Claims, 5 Drawing Sheets

MULTISTAGED TELESCOPE BOOM

BACKGROUND OF THE INVENTION

TECHNICAL FIELD OF THE INVENTION AND PRIOR ART

The present invention relates to a multistaged telescope boom.

There is no restriction of the invention neither to any particular type of such telescope boom nor to any special use thereof, which may for instance be for moving loads, such as components for building work, or just for getting access to objects located on a high level, such as windows for cleaning purposes.

The number of arms of such a telescope boom is two or more, but may be arbitrary and is often in the range of five to ten.

That the hydraulic system "is designed to force the hydraulic unit" is here to be interpreted that there is no control unit ensuring that the cylinder chambers in question is successively filled or drained, but this is ensured by mechanical means, so that there is no possibility to obtain another way of operation, but the hydraulic units are "forced" to operate in this way.

The invention is not restricted to a telescope boom having all the hydraulic units operating fully sequentially, i.e. so that a cylinder does not start to extend before the cylinder belonging to the next inner arm has been fully extended and the cylinder does not start to retract before the cylinder belonging to the next outer arm has been fully retracted, but this shall at least be the case for the cylinders belonging to the two innermost arms. This means for example in the case of seven cylinders that the four belonging to the four innermost arms may be designed to operate in this way, whereas the three cylinders belonging to the three outermost arms have a non-fully sequential operation.

However, it is preferred to have all the hydraulic units operating fully sequentially. For a multistaged telescope boom having no such control of the sequence of extending and retracting of the arms the structure has to be over-dimensioned for ensuring that the boom will manage the worst loading case. This means that for taking care of structural safety the smaller arm should withstand maximum load derivate from short outreach, so the design thereof should be as strong as the bigger arms. Similar considerations have to be made for any structural member belonging to such a telescope boom. This leads to a very heavy structure and high costs of such a boom.

By instead forcing the hydraulic units to operate according to a sequence as defined in the introduction each arm and other structural members belonging to the boom may be designed for exactly the maximum load to be taken by that member only during such operation, so that the structure may be light and economic, also thanks to the possibility to reduce the size of the cylinders of the hydraulic units.

A multistaged telescope boom as defined in the introduction having a fully sequential operation is for example known through the European patent 0 566 720. In spite of the advantages described above of a telescope boom operating in this way this telescope boom has still some drawbacks. The cylinders of the different hydraulic units of this and also other telescope booms are not located on the longitudinal centre axis of the boom, but at a distance thereto in the transversal direction. The cylinders are normally located on top and aside the telescopic arms. Such locations create additional moments on said arms when the cylinders driving forces act thereupon. Friction forces are not the only forces creating such additional moments, but they are very important and cause under certain circumstances great problems, so that the discussion below will be restricted to friction forces, although they do not constitute the only problem. When an arm of such a telescope boom extends such friction forces are created between the arm extending and the members guiding this arm inside the arm next thereto in the horizontal direction as well as in the vertical direction. As the arm extends the overlay of the arms becomes smaller and the friction forces higher, and the cylinder in question has to be dimensioned to be able to overcome these forces for obtaining the extension. The additional forces needed for the extension as a consequence of the friction forces induces additional bending moments on the boom profiles including the telescopic arms. That effect is proportional to the magnitudes of said distance to the longitudinal centre axis of each telescopic arm. A multiplying effect happen at the boom tip position when several arms are extended, since the deformation resulting from the extension of the first arm has its effect on following arms carried thereby and so on. This means that due to said induced moments on the telescopic arms the telescope boom tip moves up or down and sideways in a magnitude which depends on total boom outreach and forces needed to move actual moving arms when extending or retracting operations start.

If a cylinder is for instance located above said boom centre axis it has to push as much as needed for among others overcome friction forces on extension sliders for extension, which means that the arm in question will be deflected "downwards" in a vertical plane and also laterally in a horizontal plane in case the cylinder is out of the vertical plane including said boom centre axis. The opposite will happen if the different cylinders have to retract the telescope boom.

It is obvious that this phenomena may be very disturbing under certain working conditions, such as when starting to retract or extend at a nearly full outreach of the boom when it is a part of a sky lift and a person stands in said sky lift on a high level, for instance for cleaning windows. Such vertical and especially lateral movements of the boom tip may then be very unpleasant. In other situations such movements may result in difficulties to carry out certain type of works at a high accuracy required or other problems.

SUMMARY OF THE INVENTION

The object of the present invention is to provide a multistaged telescope boom of the type defined in the introduction reducing the drawbacks described above of such booms already known.

This object is according to the invention obtained by providing such a multistaged telescope boom in which at least the hydraulic unit of said innermost arm is provided with an arrangement adapted to isolate the cylinder chamber of that first cylinder from communication with said hydraulic system when that cylinder is fully extended and re-establish said communication upon fully retraction of the cylinder next to said first cylinder.

This means that said multiplying effect with respect to the influence of friction forces between said first cylinder and the next cylinder will not occur, since once the first cylinder is fully extended it has no need to be active any longer to extend or retract, so that active forces only needs to be applied to the moving cylinder. This means for instance in the case of a higher number of hydraulic units all provided with a said first cylinder except for the one belonging to the outermost arm, that when the telescope boom is fully extended and the outermost arm is started to retract only the cylinder belonging to this arm pulls, so that vertical and/or lateral movement of the boom tip position due to friction forces will only emanate therefrom and be much smaller than for the prior art telescope boom. When the cylinder belonging to the outermost arm try to retract in the prior art multistaged telescope boom all cylinders pull and the boom tip position will swing to a large extent both vertically and laterally.

According to a preferred embodiment of the invention said arrangement is adapted to obtain said isolation by means located within the cylinder jacket of said first cylinder, which is preferred, since such means are then well protected within the cylinder jacket. It is then also preferred to influence hydraulic flow paths within the cylinder jacket of said first cylinder for isolating said cylinder chamber of said first cylinder.

According to a preferred embodiment of the invention said arrangement is adapted to obtain said isolation and re-establishment of communication by pieces of said hydraulic unit forced to move by the piston or parts moving therewith when reaching full extension of the first cylinder and fully retraction of said next cylinder, respectively. Accordingly, this means that no control is needed for obtaining said isolation of the cylinder chamber from the hydraulic system, but this will automatically be obtained by said piece moved by the piston of said first cylinder at the end of the stroke thereof. The same apply for said re-establishment of communication between said cylinder chamber and the hydraulic system, which will take place automatically when the piston of said next cylinder has been moved to the fully retracted position of that cylinder and by that moved a said piece for obtaining said re-establishment. Thus, there is no need of any complicated and costly control for obtaining this and no risk of any faulty operation as a consequence of failure of such a control.

According to another preferred embodiment of the invention said arrangement comprises a first member adapted to block a hydraulic supply line to said cylinder chamber of the first cylinder in the reverse direction when this cylinder reaches full extension and a second member adapted to divert the hydraulic flow from the supply line to said cylinder chamber to a line to the next cylinder when this cylinder reaches full extension. Said second member is preferably located within the cylinder jacket of said first cylinder and it may be adapted to divert said hydraulic flow downstream an inlet into said first cylinder, which is preferred, since the diversion of the hydraulic flow will then take place where it may not be accidentally influenced by outer means. Said first member then preferably comprises a check valve arranged in said hydraulic supply line to said cylinder chamber. This means that once a cylinder chamber has been completely filled it will be isolated and the hydraulic supply line will be connected to the next cylinder for extension thereof.

According to another preferred embodiment of the invention said second member is arranged to be mechanically controlled by means connecting to the piston for being controlled in dependence of the position of the piston, which reliably ensures that the next cylinder will not be connected to the hydraulic supply line before the cylinder chamber of said first cylinder has been completely filled and this cylinder completely extended.

According to a preferred embodiment of the invention constituting a further development of the embodiment last mentioned said second member comprises two pieces with openings to the hydraulic supply line to said first cylinder and to the line to the next cylinder, respectively, and said means is adapted to create a displacement of these pieces with respect to each other when the piston reaches the fully extended position for bringing said openings in an overlap and divert said hydraulic supply to the line to the next cylinder. Such a mutual displacement of said two pieces will reliably ensure a connection of said next cylinder to the hydraulic supply line when the piston of said first cylinder reaches the full extended position and not before.

According to another preferred embodiment of the invention said first cylinder comprises a pipe extending axially from the cylinder bottom through the cylinder chamber and into a hollow piston rod of the hydraulic unit, and the interior of the hollow piston rod communicates with said line to the next cylinder and said second member is adapted to connect the interior of the pipe and thereby the next cylinder to the hydraulic supply to the first cylinder upon fully extension of said first cylinder. This constitutes a simple way to pass said hydraulic supply to said next cylinder while isolating the cylinder chamber of the first cylinder therefrom.

According to another preferred embodiment of the invention said pipe is axially movable with respect to said cylinder bottom and in a rest state spring-biased into a position isolating the interior thereof from said hydraulic supply to the first cylinder, and mechanical means are arranged to move the pipe against said spring action by movement of the piston at the end of the extension movement of the first cylinder for connecting the interior of the pipe to said hydraulic supply to the first cylinder. This will reliably ensure that the next cylinder is not connected to said hydraulic supply to the first cylinder until the piston reaches the end of its movement for the extension of the first cylinder and then overcome said spring action. "Spring-biased" and "spring action" is to be interpreted broadly, and it has not to be a question of a physical spring, but any means having the same behaviour is conceivable, such as a slightly compressed rubber cushion or the like.

According to another preferred embodiment of the invention said arrangement comprises a third member spring-biased into a position closing an exhaust opening of the cylinder chamber of said first cylinder and a fourth member adapted to press said third member out of said closing position for exhausting hydraulic fluid from the cylinder chamber through control by the hydraulic unit comprising said next cylinder depending upon the arrival of the latter to the fully retracted state. With respect to "spring-biased" the same interpretation as for the previous embodiment shall apply. It is in this way reliably obtained that said first cylinder will not start to retract or even pull before said next cylinder has been fully retracted.

According to another preferred embodiment of the invention said third member and said exhaust opening are designed to gradually and/or step by step increase the cross section of a flow path from said cylinder chamber to the hydraulic system upon pressing by the fourth member of the third member further away from said closing position. This takes care of a problem that would arise if said exhaust opening is suddenly completely opened to communicate with said hydraulic system. In such a case a sudden expansion of hydraulic fluid would create an enormous flow peak which in turn results in a pressure peak inside the first cylinder, which disturbs pressure equilibrium of retracting cylinder and moving parts resulting in quick decelerations on moving masses, which in combination with components play produce noises in the form of big bangs. However, this behaviour is avoided by gradually and/or step by step increase the cross section of the flow path. In a particularly preferred embodiment said third member and said exhaust opening are designed, upon moving of the third member away from said closing position, to firstly connect said cylinder chamber with the hydraulic system through a first opening with a small cross section and when moved further through a second opening with a substantially larger cross section. By first establishing a connection through said first opening creating a nozzle between the cylinder chamber and the hydraulic system the cylinder chamber will be depressurized, so that noticeable peak flows from that chamber upon opening the free passage of hydraulic fluid through the second opening will be avoided thus avoiding acceleration/decelerations during the retracting operation. This will avoid the creation of said big bangs or other disturbing noises. The cross section of said first opening is advantageously ⅓-1/20, preferably ⅕-1/15 and most preferred ⅛-1/12 of the cross section of said second opening.

It is preferred that there is a distance between said two openings resulting in a so called dead stroke of said third member upon connection through said first opening before connection through said second opening for obtaining said depressurization before the connection through the second opening is established.

According to another preferred embodiment of the invention said fourth member has at least one opening adapted to participate in forming a flow part from the cylinder chamber to said hydraulic system, and said first and second openings are preferably provided in said fourth member.

According to another preferred embodiment of the invention said first cylinder comprises a piece adapted to be mechanically hit by a member of the next cylinder in the end of a retraction movement thereof for causing said fourth member to press said third member out of said closing position. This ensures in a reliable way that the cylinder chamber of said first cylinder will be isolated from said hydraulic system until the next cylinder has been fully retracted.

According to another preferred embodiment of the invention said first cylinder and the next cylinder comprise an inlet port to the rear side of the respective piston for connection to said hydraulic system for applying a hydraulic pressure upon the piston for retracting the respective cylinder, and said inlet ports are connected in series with the one belonging to the innermost cylinder before the one belonging to the next cylinder. This ensures that said next cylinder will retract firstly and that said fourth member will be pressed against said third member during the entire retraction of said first cylinder.

According to another preferred embodiment of the invention said first cylinder comprises a pipe extending axially from the cylinder bottom through the cylinder chamber and into a hollow piston rod of the hydraulic unit, the interior of the pipe being adapted to communicate with the said hydraulic system, and said exhaust opening being adapted to connect said cylinder chamber to the interior of the pipe for connection to the hydraulic system therethrough. This constitutes a preferred way of draining said cylinder chamber of the first cylinder when this cylinder is retracted.

According to another preferred embodiment of the invention all hydraulic units except for the one belonging to the outermost arm have the above features of any of the embodiments according to the invention of the hydraulic unit belonging to the innermost arm, so that all hydraulic units are forced to operate fully sequentially for filling the cylinder chamber of one cylinder at the time from the hydraulic unit of the innermost arm to that of the outermost arm when extending the boom and draining the cylinder chambers of the hydraulic units in the opposite order when retracting the boom. The advantages of such a fully sequentially operating telescope boom appear clearly from the discussion above.

Further advantages and advantageous features of the invention appear from the following description.

BRIEF DESCRIPTION OF THE DRAWINGS

With reference to the appended drawings, below follows a specific description of a multistaged telescope boom according to preferred embodiments of the invention.

In the drawings.

DETAILED DESCRIPTION OF PREFERRED EMBODIMENTS OF THE INVENTION

Figure 1:
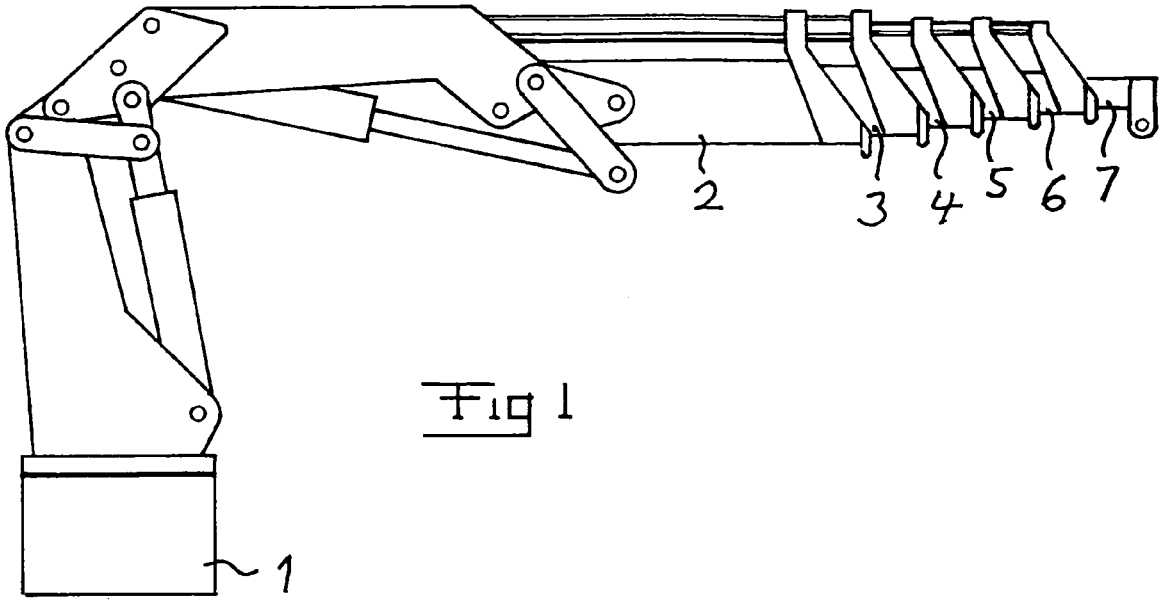
FIG. 1 is simplified view illustrating a multistaged telescope boom of the type according to the invention, in particular adapted to be placed on a truck.

A multistaged telescope boom of the type according to the invention is schematically illustrated in FIG. 1. This boom is in particular for a loading crane on a truck, to which the boom may be attached through a base member 1 thereof. The telescope boom comprises a number of telescopic arms 2-7 and a hydraulic unit, comprising a piston and a cylinder, arranged between each successive such telescopic arms.

Figure 2:
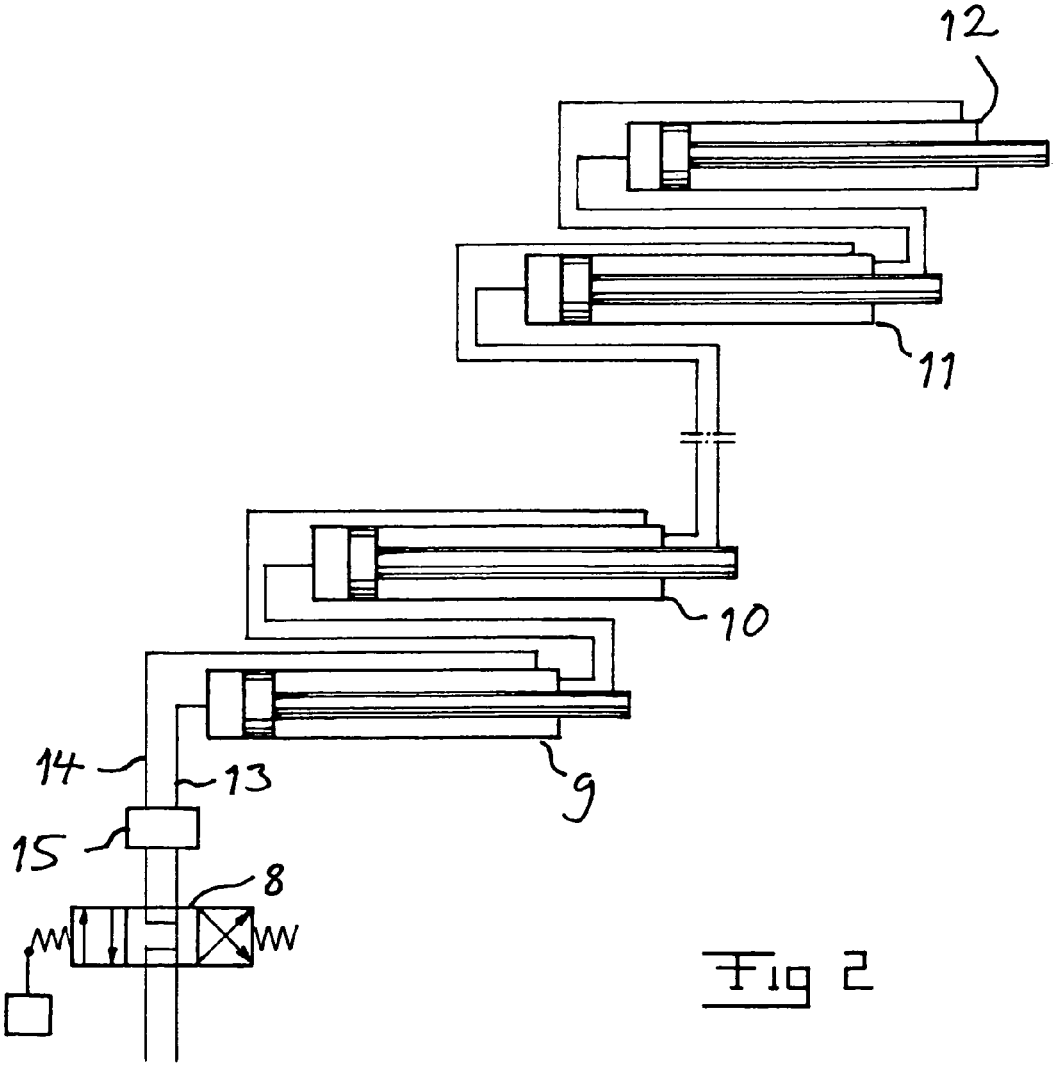
FIG. 2 is a schematic view illustrating the principle of operation of the hydraulic system of a multistaged telescope boom according to the invention.

FIG. 2 illustrates schematically the hydraulic system connecting to the different hydraulic units in the telescope boom according to the present invention for operation thereof. A distributor unit 8 is adapted to control the operation of the hydraulic units 9-12 (extending/retracting) belonging to the hydraulic system. Hoses 13, 14 connect the distributor unit with the hydraulic cylinder 13 belonging to the innermost arm. A load holding valve 15 is inserted between the distributor unit 8 and the cylinder 9 to prevent unintended movements of the cylinders in case of a hose failure. The different cylinders are according to the invention designed so that they are forced to operate fully sequentially for filling the cylinder chamber of one cylinder at the time from the hydraulic unit of the innermost arm (cylinder 9) to that of the outermost arm (cylinder 12) when extending the boom and draining the cylinder chambers of the hydraulic units in the opposite order when retracting the boom.

Figure 3:
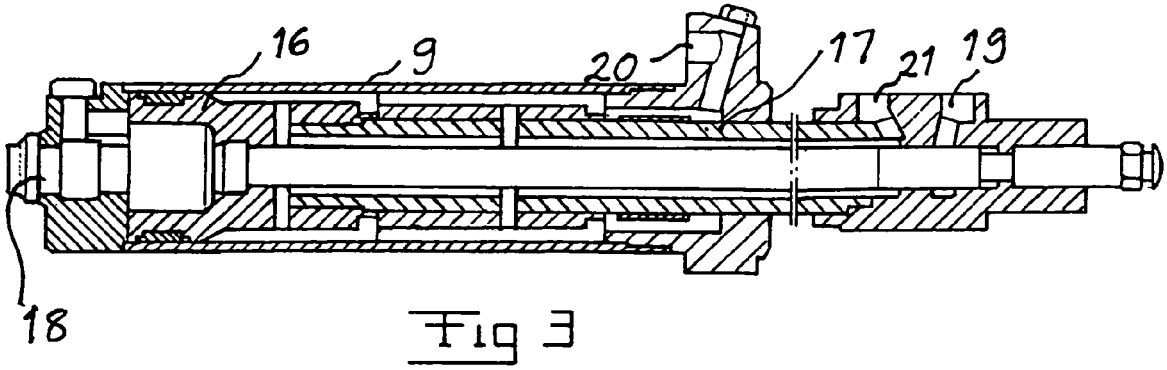
FIG. 3 is a simplified cross section view through a said first cylinder in a multistaged telescope boom according to the present invention.

All the cylinders except for the one 12 belonging to the outermost arm have preferably the same design, which is schematically shown in FIG. 3, and which include an arrangement adapted to isolate the cylinder chamber of the cylinder from communication with said hydraulic system when the cylinder is fully extended and re-establish said communication upon fully retraction of the cylinder belonging to the next outer arm. This cylinder is in FIG. 3 schematically shown in the fully retracted position. The cylinder 9 has a piston 16 displaceable therein and a hollow piston rod 17 connected thereto and moving therewith for extension and retraction of the cylinder. The hydraulic supply line of the hydraulic system is connected to a port, an inlet 18, for acting upon the piston 16 for extension of the cylinder. An outlet 19 is arranged for connecting the hydraulic supply line through the inlet 18 and the cylinder to a corresponding inlet 18 of the cylinder belonging to the next outer arm of the telescope boom. How this is done will be described more in detail further below. The cylinder has a second inlet 20 connecting to the hydraulic system for applying a hydraulic pressure to the piston 16 when retracting as well as a second outlet 21 connecting the inlet 20 through the cylinder to a corresponding inlet 20 of the cylinder belonging to the next outer arm. The function of the cylinder will appear from the detailed description of the design of the cylinder following below with reference made to FIGS. 4-9.

Figure 4:
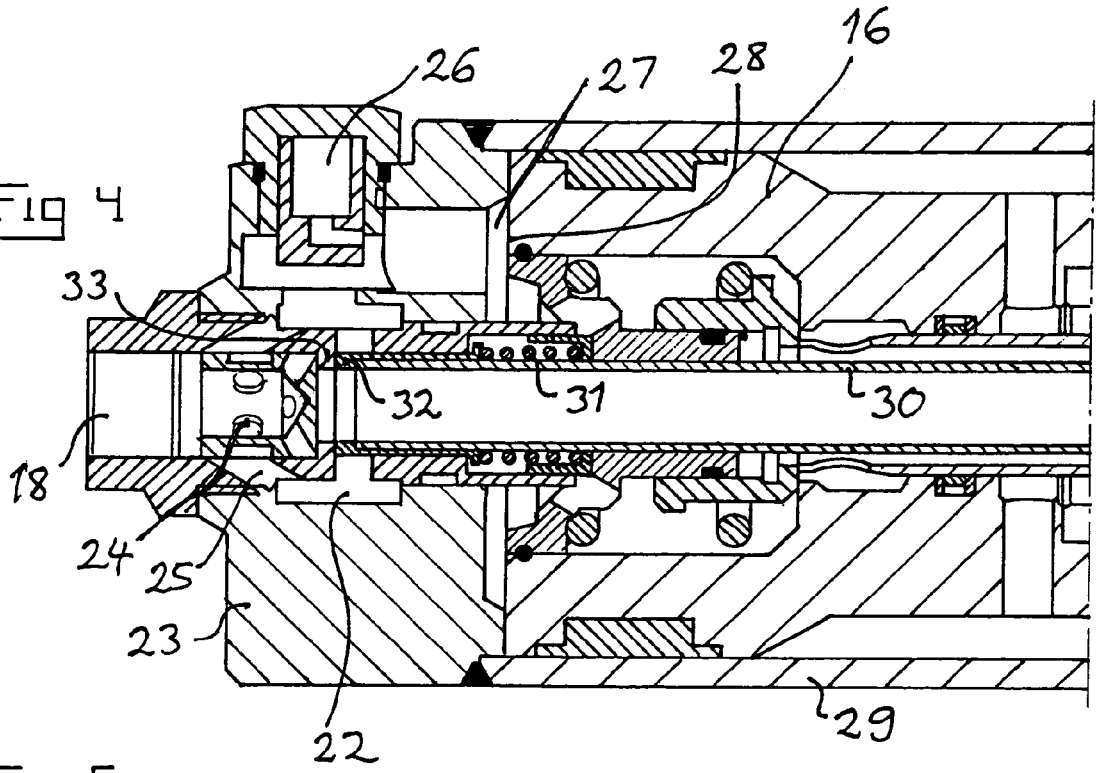
FIG. 4 is an enlarged detailed cross section view of one end of the hydraulic cylinder shown in FIG. 3 in a fully retracted state.

The cylinder is in FIG. 4 shown in the fully retracted position and it is now assumed that the distributor unit 8 (see FIG. 2) is controlled to start an extension of that cylinder. The hydraulic supply line does then connect the inlet 18 to the hydraulic system and feeds hydraulic fluid with a pressure thereinto. The hydraulic fluid enters a distributing chamber 22 arranged in the cylinder bottom 23 through passages 24, 25. This results in an opening of a check valve 26 also arranged in the cylinder bottom allowing the hydraulic fluid to enter into the cylinder chamber 27 for acting upon the front wall surface 28 of the piston 16 for starting to displace it inside the cylinder jacket 29 to the right in the figure for extension of the cylinder.

The cylinder also has a pipe 30 extending axially from the cylinder bottom 23 and further into a hollow piston rod communicating with the inlet 18 of the next cylinder. This pipe 30 is in a rest state shown in FIG. 4 spring-biased through a spring 31 into a position closing a passage between the distributing chamber 22 and the interior thereof and by that isolating the interior of the pipe from the hydraulic supply through the inlet 18. The pipe 30 has at its left end a portion 32 with an increase in diameter producing an axial force against the cylinder bottom portion 33 due to the diameter difference at this point and seals said portions against each other. Any built in pressure into the cylinder chamber 27 will actually push the pipe 30 against the portion 33 for assisting the spring 31 to seal the interior of pipe 30 with respect to the distributing chamber 22. This means that the hydraulic fluid may during the extension phase not reach the next cylinder.

Figure 5:
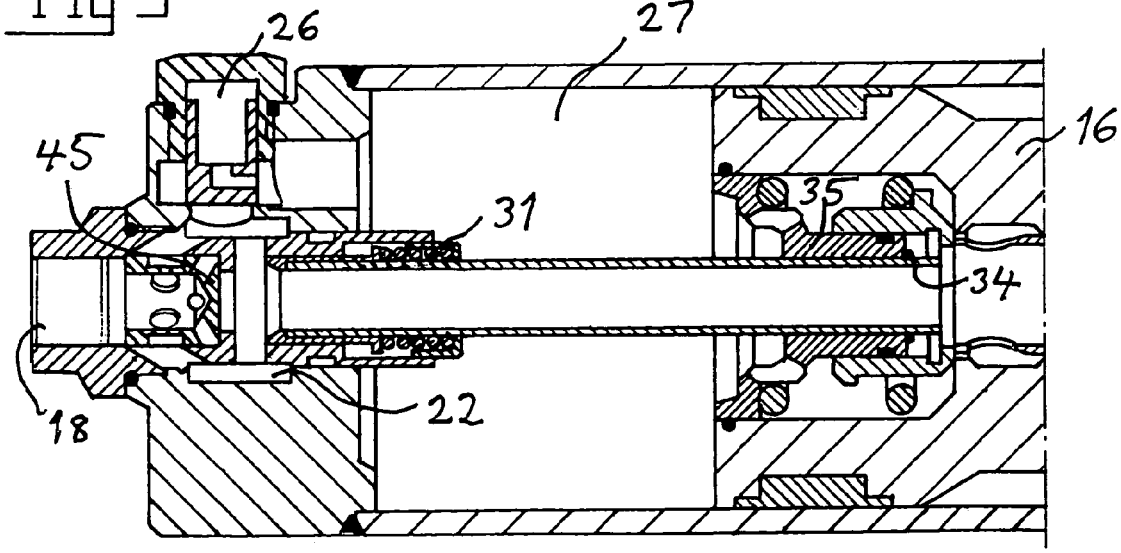
FIG. 5 is a view corresponding to FIG. 4 of the cylinder in the fully extended state.

It is illustrated in FIG. 5 how the piston 16 has moved to the fully extended position of the cylinder. A stopper 34 is arranged on the pipe 30 and will at the end of the extension stroke be hit by a slider 35 rigidly connected to the piston 16, which starts to pull the pipe 30 against the action of the spring 31 opening a passage between the distributing chamber 22 and the interior of the pipe and by that the fluid entering the inlet 18 may flow through the pipe 30 to the next cylinder for starting the extension thereof. When the fluid pressure on the distributing chamber 22 becomes equal or lower than the pressure on the cylinder chamber 27 the check valve 3 will close and the cylinder chamber 27 will be kept isolated and the fluid therein will be trapped under present inbuilt fluid pressure without any possibility for the fluid to leave the cylinder chamber 27 towards the distributing chamber 22, since the check valve 26 will always close in that direction.

Figure 6:
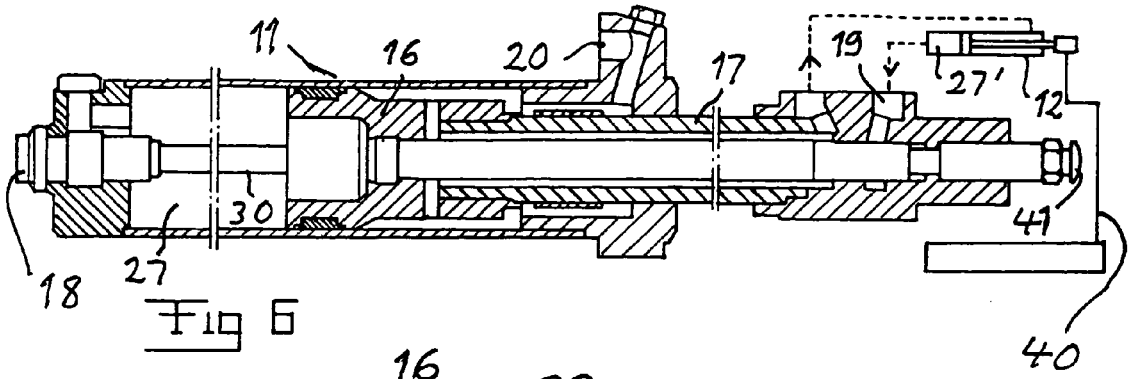
FIG. 6 is a view corresponding to that of FIG. 3 of the cylinder, but here in the fully extended state.
Figure 7:
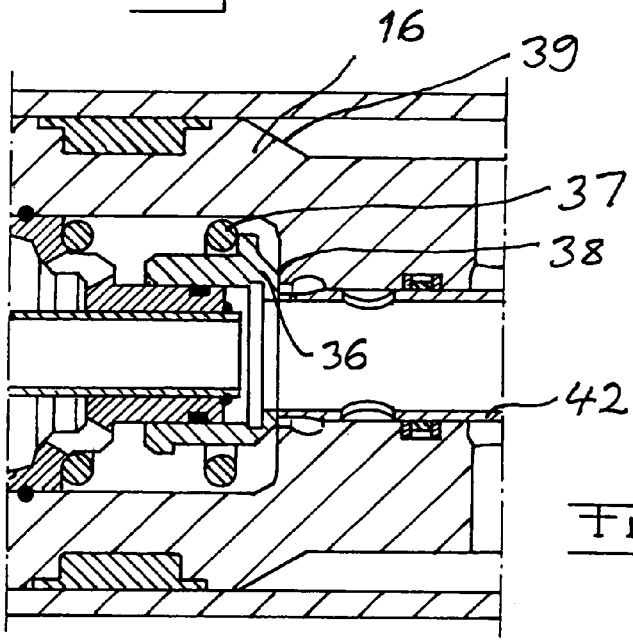
FIG. 7 is a slightly enlarged view corresponding to FIG. 5 of the piston of the first cylinder and parts associated therewith in the fully extended position.
Figure 8:
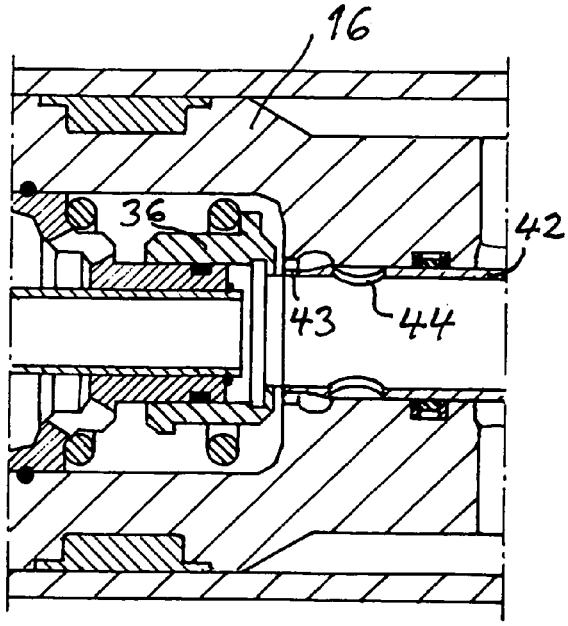
FIG. 8 is a view similar to that according to FIG. 7 when the retraction of the cylinder is initiated.
Figure 9:
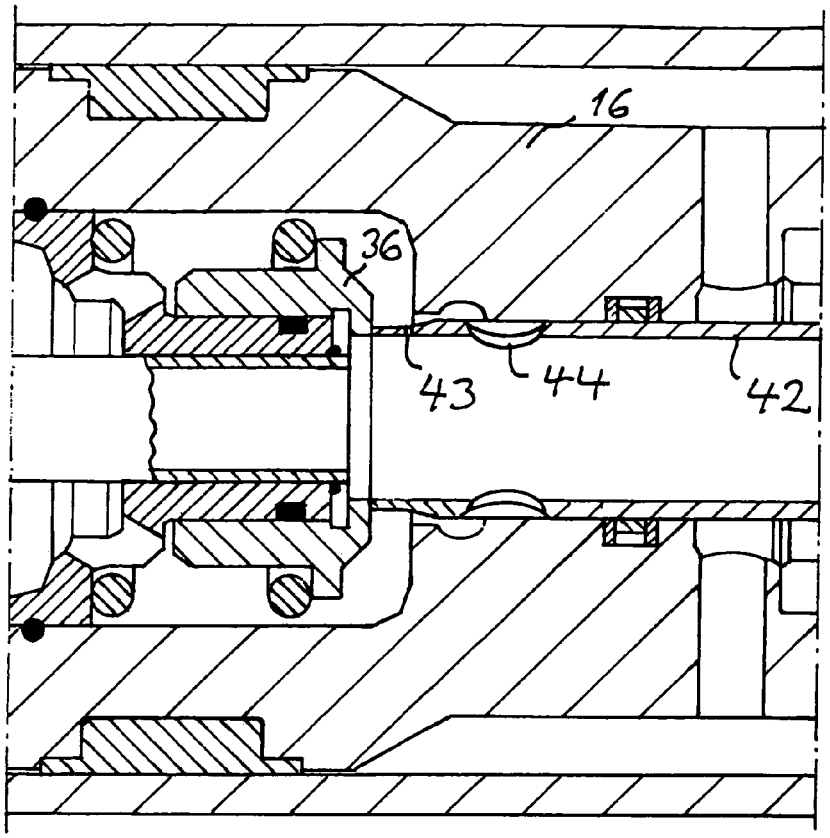
FIG. 9 is a view similar to that according to FIGS. 7 and 8 during the retraction phase of the cylinder.

The fully extended position of the cylinder is schematically illustrated in FIG. 6. We do now assume that all the cylinders of the telescope boom are extended and a retraction of the telescope boom is to be started. The distributing unit 8 does then connect the hydraulic pressure to the second inlet 20, and this fluid will reach all cylinders being connected in series, but only the one 12 extended last will start to retract. Fluid coming out from the cylinder chamber 27' thereof is returned to the hydraulic supply through a conduit created through all the cylinders through the former outlet 19, the hollow piston 17, the pipe 30 and the former inlet 18 through all the cylinders. However, all cylinders extended except for the outermost 12 can not retract, since the pressurised cylinder chambers 27 thereof are isolated on one hand from the inlet/outlet 18 through the closed check valve 26 and on the other through a member 36 spring-biased through a spring 37 acting between the member 36 and the piston 16 for pressing it towards a bottom wall 38 of the piston for closing a possible exhaust opening of the cylinder chamber.

All inlets 20 are as mentioned connected in series, so all cylinders will try to retract under fluid pressure needed to retract the "last extended" cylinder. This means that this fluid pressure will act upon rear wall surfaces 39 of the respective piston. The inbuilt pressures in the cylinder chambers of the cylinders fully extended will keep those cylinders in the fully extended position, so that only the last cylinder will retract.

Accordingly, it is necessary to open a communication channel between the cylinder chamber 27 and the inlet/outlet 18 for making it possible to retract a cylinder. This is achieved in the following way. When the retracting cylinder reaches a position close to its most retracted position a piece 40 (very schematically indicated in FIG. 6) moving with the piston of the cylinder in question will hit a member 41 of the next cylinder and push it in the retracting direction of that cylinder. The member 41 will push a second pipe 42 slidably arranged inside the hollow piston rod 17 and resting with its one end against the member 36. This means that the member 36 will be pressed against the action of the spring 37 out of its contact with said bottom wall 38.

The end of the pipe 42 has two openings, namely a first opening 43 of a small cross section located closest to said end and a second opening 44 with a much larger cross section located at a distance in the axial direction to the first one. This means that when the pipe 42 pushes the member 36 out of its contact with the bottom wall 38 hydraulic fluid from the cylinder chamber may flow through the first opening 43 creating a small nozzle and depressurizing the cylinder chamber (position according to FIG. 8). This will be the case during the "dead stroke" when the pipe 42 moves further, until the cylinder chamber is connected to the second opening 44 of a much larger cross section enabling the cylinder chamber to be exhausted through the outlet 18. The cylinder chamber is at this moment already depressurized thanks to the first opening 42, so that no noises or big bangs will occur.

The piece 45 (see for example FIG. 4) will be pushed to the left in that figure by the hydraulic fluid leaving the cylinder chamber, so that the fluid may reach the outlet 18 through the passages 24. As long as hydraulic fluid pressure is connected to the second inlet 20 it will induce a pressure on the cylinder chamber 27 by acting on the rear wall surfaces 39 of the piston while the member 36 remain separated from the bottom wall 38 by the action of the second pipe 42 and the retracting cylinder will continue to retract until reaching its fully retracted position. When approaching that position the same condition is achieved with the preceding cylinder by pushing the member 41 thereof when starting retraction of that cylinder.

Figure 10:
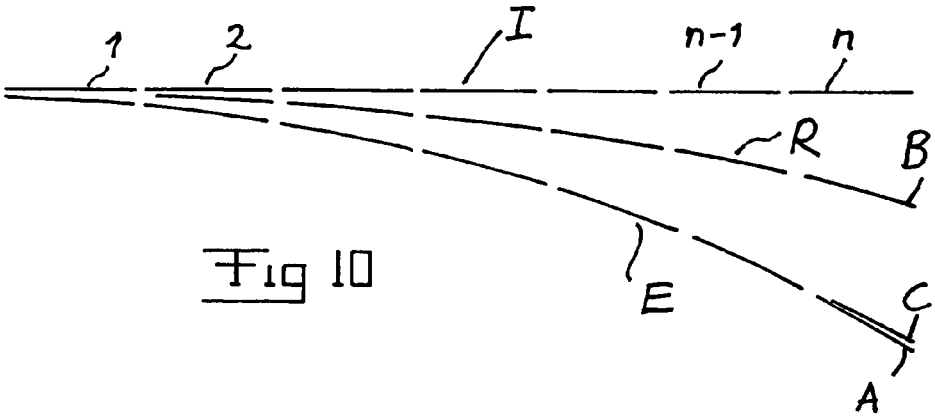
FIGS. 10 and 11 are views schematically comparing the behaviour of vertical deflection and lateral deflection, respectively, of a multistaged telescope boom according to the invention and one according to the prior art when extending and retracting.
Figure 11:
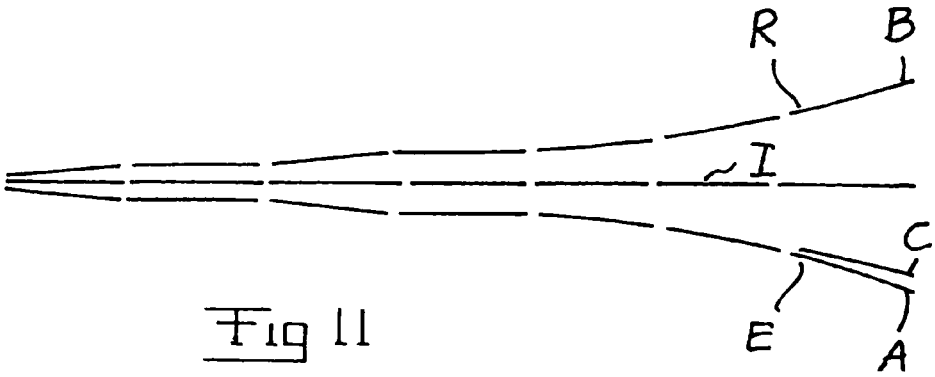

The influence of the design of the telescope boom according to the invention, in the case of all cylinders except for the one belonging to the outermost arm provided with an arrangement adapted to isolate the cylinder chamber of the cylinder from communication with the hydraulic system when the cylinder is fully extended and re-establish said communication upon fully retraction of the cylinder next thereto, upon the behaviour of such a telescope boom will now be explained by means of FIGS. 10 and 11. The straight lines I show an idealised telescope boom of n extensions being unloaded. This boom will be deflected by lifting load, structure weight and moments created by the cylinders when pushing as indicated through the lines E showing the extension of the boom. FIG. 10 illustrates the deflection in the vertical plane, whereas FIG. 11 illustrates the deflection in the horizontal plane, e.g. as seen from above.

The lines R shows what happens for a telescope boom according to the prior art during retraction. If the last cylinder try to retract, but is still not retracting, all extension cylinders will pull and the telescope boom will change position from A to B. It is seen that the boom tip position will vary a lot, especially in the lateral direction causing a substantial so called side bending. However, in the case of a telescope boom according to the present invention only the moving cylinder pulls when retracting, since the cylinder chambers of all the other cylinders are isolated from the hydraulic system of the telescope boom, which means that the boom tip position will move from A to C when the last cylinder tries to retract, which constitutes a tremendous improvement with respect to the problems of deflection, especially lateral deflection.

Figure 12:
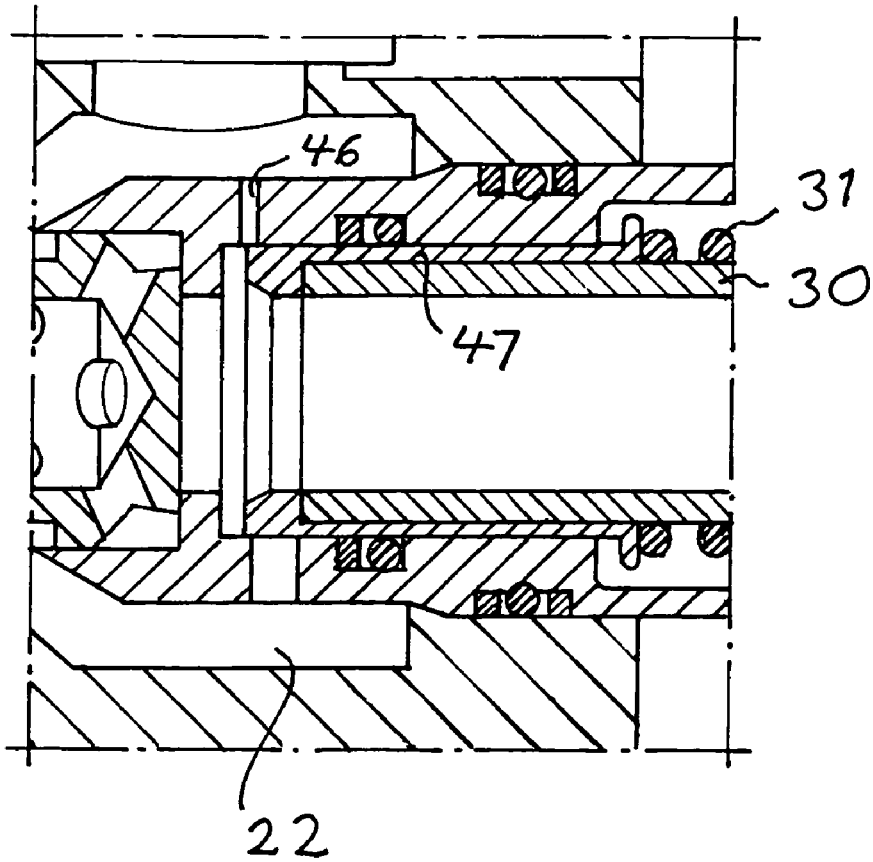
FIG. 12 is an enlarged view corresponding to the left part of FIG. 5 of a cylinder in a telescope boom according to a second embodiment of the present invention.
Figure 13:
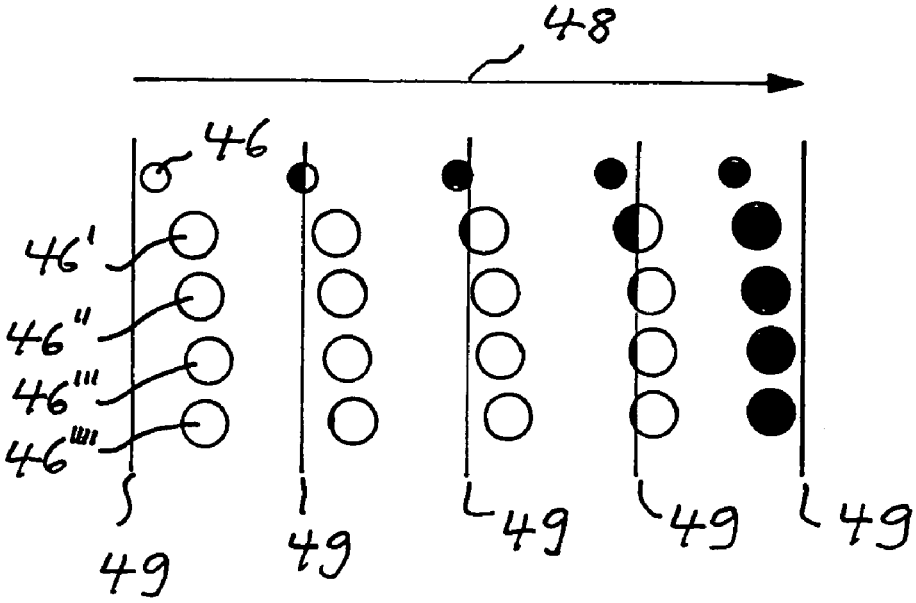
FIG. 13 is a very simplified view used to illustrate a feature of the embodiment shown in FIG. 12.

A part of a cylinder in a telescope boom according to a second preferred embodiment of the invention is illustrated in FIG. 12. This cylinder is modified with respect to the cylinder described above by the arrangement of not one, but a plurality of holes 46, 46', 46", 46''', 46'''' made in the cylinder bottom piece and adapted to connect the distributing chamber 22 with the interior of the pipe 30 for diverting the hydraulic supply to the next cylinder through the interior of the pipe 30 when the piston is reaching the end of the stroke thereof. The holes 46, 46', 46", 46''', 46''''are distributed circumferentially with respect to said pipe 30 and also in the direction of movement of the piston, which is schematically illustrated in FIG. 13. They are all closed by an external wall, in fact a part 47 integral therewith, of the pipe 30 in the rest state of the pipe 30 defined by the action of the spring 31. The cross section of a flow path from said distributing chamber 22 into the interior of the pipe 30 is adapted to be formed by the cross sections of said holes 46-46''''. The holes are to be opened by movement of the pipe 30 while storing potential energy in the spring 31 at the end of the stroke, so that the cross section of said flow path will gradually increase as the part of the hole cross sections opened increases as the pipe 30 moves according to the arrow 48 in FIG. 13. The hole 46 to be opened firstly is arranged so that the pipe 30 has to move a predetermined distance from the position thereof in said rest state before a connection between the distributing chamber 22 and the interior of the pipe is established through this hole. The lines 49 indicate the end of the pipe in the schematic view in FIG. 13, and the filled parts of the holes form together the cross section of the flow path from the distributing chamber to the interior of the pipe 30.

Furthermore, it is shown that the hole 46 firstly opened by the movement of the pipe 30 has a smaller cross section than the hole 46' next thereto.

The design according to FIGS. 12 and 13 for diverting the hydraulic supply to the next cylinder at the end of the stroke of the piston solves a problem that would arise if the flow path would be established as soon as the pipe 30 moves away from the rest state position. When in such a case the piston approaches its last stroke millimetres, the pipe 30 starts to move away from the rest position thereof, and as soon as the pipe 30 has left said rest state position by only a few hundreds of millimetres a very small flow will come through the gap so created feeding the next cylinder through the interior of the pipe, even though the first cylinder has not reached its stroke end. This means that the next cylinder would start to extend under very low flow causing vibrations. The extending extension associated with said first cylinder has then also reached its minimum overlay, which means that great forces are involved on sliders and the like, and stick-sleep phenomena occur, so that pressure "pulses" appear and act on the pipe 30 as closing diameter with the pipe 30 is greater than the closing diameter with the slider 35. Such "pulses" also consist of small cylinder length variations induced by extension elastic deformation and pressure variations on piston/cylinder chambers. Such pulses tend to vary the position of the pipe 30 in the range of few hundreds of millimetres, which force the pipe 30 to close momentary against the portion 33. The cylinder chamber is also submitted to such pulses and this all together create an opening/closing instability during the initial part of the extension of said next cylinder. This instability also creates audible vibrations.

However, this problem is avoided thanks to the design according to FIGS. 12 and 13. This is obtained by the fact that the pipe 30 has to move a predetermined distance before the flow path is opened through the hole 46 and the flow path is also opened gradually. The first hole 46 of a smaller diameter allows a smooth and progressive opening. The hole 46 is located to force the pipe 30 to move about 0.5 millimetres prior to be opened and creating a flow of hydraulic fluid towards the next cylinder. Under such circumstances pressure pulses induce on the pipe 30 length variations which are of no significance and not capable of closing the hole 46, so that no vibrations mentioned above will occur.

The invention is of course not in any way restricted to the embodiment described above, but many possibilities to modifications thereof should be apparent to a person with ordinary skill in the art without departing from the basic idea of the invention as defined in the appended claims.

The shape and mutual proportions of parts of said first cylinder may of course be different than shown in the figures and vary within a broad range.

"Gradually and/or step by step" with respect to the increase of said flow path cross section may be obtained in many other ways than described above with reference to FIGS. 7-9. There may for instance be a longitudinal opening in the form of a slit of a constant or varying width. The cross section is then increased by exposing more and more of said slit. There may also be more than two consecutive openings with the same or different cross section, for instance increasing in the order they are connected to said cylinder chamber.

The invention claimed is:

1. Multistaged telescope boom, in particular for a loading crane on a truck, where a hydraulic unit, comprising a piston (16) and a cylinder (9-12), is arranged between successive, telescopic arms (2-7), said boom comprising a hydraulic system connecting to said hydraulic units for the operation thereof and arranged to force the hydraulic units of at least the two innermost arms for filling a cylinder chamber (27) of one of these cylinders at a time, starting from the innermost arm and moving outwardly in the order of the arms when extending the booms, and draining said cylinder chambers in the opposite order when retracting the boom, wherein at least the hydraulic unit of said innermost arm is provided with an arrangement structured and arranged to isolate and block the cylinder chamber (27) of that first cylinder from communication with said hydraulic system when that cylinder is fully extended, and re-establish said communication upon full retraction of the cylinder next to said first cylinder.

2. A telescope boom according to claim 1, wherein said arrangement isolates and blocks the cylinder chamber (27) from within a cylinder jacket (29) of said first cylinder.

3. A telescope boom according to claim 1, wherein said arrangement influences hydraulic flow paths within a cylinder jacket (29) of said first cylinder for isolating said cylinder chamber (27) of said first cylinder.

4. A telescope boom according to claim 1, wherein said arrangement obtains said isolation and reestablishment of communication by pieces (30, 42) of said hydraulic unit forced to move by the piston (16) or part (35) moving with the piston (16) when reaching full extension of the first cylinder and full retraction of said next cylinder, respectively.

5. A telescope boom according to claim 1, wherein all hydraulic units except for the one belonging to the outermost arm have the above features of the hydraulic unit belonging to the innermost arm, so that all hydraulic units are forced to operate fully sequentially for filling the cylinder chamber (27) of one cylinder at a time from the hydraulic unit of the innermost arm to outermost arm when extending the boom and draining the cylinder chambers of the hydraulic units in the opposite order when retracting the boom.

6. a telescope boom according to claim 1, wherein all said cylinders, hydraulic units and arms are arranged on the same longitudinal axis.

7. A multistaged telescope boom, in particular for a loading crane on a truck, where a hydraulic unit, comprising a piston (16) and a cylinder (9-12), is arranged between successive, telescopic arms (2-7), said boom comprising a hydraulic system connecting said hydraulic units for the operation thereof and arranged to force the hydraulic units of at least the two innermost arms for filling a cylinder chamber (27) of one of these cylinders at a time, starting from the innermost arm and moving outwardly in the order of the arms when extending the boom, and draining said cylinder chambers in the opposite order when retracting the boom, wherein at least the hydraulic unit of said innermost arm is provided with an arrangement structured and arranged to isolate the cylinder chamber (27) of that first cylinder from communication with said hydraulic system when that cylinder is fully extended, and re-establish said communication upon full retraction of the cylinder next to said first cylinder, and said arrangement comprises a first member (26) structured and arranged to block a hydraulic supply line to said cylinder chamber (27) of the first cylinder in the reverse direction when this cylinder reaches full extension and a second member (30) structured and arranged to divert the hydraulic flow from the supply line to said cylinder chamber to a line to the next cylinder when this cylinder reaches full extension.

8. A telescope boom according to claim 7, wherein said second member (30) is located within a cylinder jacket (29) of said first cylinder.

9. A telescope boom according to claim 7, wherein said second member (30) is structured and arranged to divert said hydraulic flow downstream from an inlet (18) into said next cylinder.

10. A telescope boom according to claim 7, wherein said first member comprises a check valve (26) arranged in said hydraulic supply line to said cylinder chamber (27).

11. A telescope boom according to claim 7, wherein said second member (30) is arranged to be mechanically controlled by a slider (35) connected to the piston (16) for being controlled in dependence of the position of the piston.

12. A telescope boom according to claim 11, wherein said second member comprises two pieces (22, 30) with openings to the hydraulic supply line to said first cylinder and to the line to the next cylinder, respectively, and said slider (35) creates displacement of these pieces with respect to each other when the piston (16) reaches the fully extended position for bringing said openings in an overlap and diverting said hydraulic supply to the line to the next cylinder.

13. A telescope boom according to claim 12, wherein the first of said two pieces of the second member is a pipe (30) and the second piece is a part of or a part fixed to a cylinder bottom (23), and said two pieces are structured and arranged such that said pipe moves a predetermined distance from the position thereof in said rest state before said overlap is created and said hydraulic supply is diverted into the pipe and therethrough to the next cylinder.

14. A telescope boom according to claim 12, wherein the first of said two pieces of the second member is a pipe (30) and the second piece is a part of or a part fixed to a cylinder bottom (23), said second piece comprises a plurality of holes (46, 46', 46'', 46''', 46'''') connected to said hydraulic supply line and closed by the external wall of said pipe in said rest state position of the pipe, these holes are distributed circumferentially with respect to said pipe (30) and also in the direction of movement of the piston to create a flow path from said hydraulic supply line to the next cylinder with a cross section arranged to increase gradually when the pipe is moving away from said rest state position by gradually adding the cross sections of additional holes opened by removing the pipe wall therefrom.

15. A telescope boom according to claim 14, wherein at least the hole (46) arranged to be opened first by the movement of said pipe from said rest state position has a smaller cross section than the hole (46') arranged to be opened next.

16. A telescope boom according to claim 7, wherein said first member (26) is structured and arranged to block the hydraulic supply to said cylinder chamber as a consequence of reduced hydraulic pressure in said supply line towards the cylinder chamber as a consequence of said diverting by said second member (30).

17. A telescope boom according to claim 7, wherein said first cylinder comprises a pipe (30) extending axially from a cylinder bottom (23) through the cylinder chamber (27) and into a hollow piston rod (17) of the hydraulic unit, and the interior of the hollow piston rod communicates with said line to the next cylinder and said second member (22, 30) is structured and arranged to connect the interior of the pipe and thereby the next cylinder to the hydraulic supply to the first cylinder upon full extension of said first cylinder.

18. A telescope boom according to claim 17, wherein said pipe (30) is axially movable with respect to said cylinder bottom (23) and in a rest state spring-biased into a position isolating the interior thereof from said hydraulic supply to the first cylinder, and mechanical interaction (34, 35) between the pipe and piston moves the pipe against said spring action by movement of the piston at the end of the extension movement of the first cylinder for connecting the interior of the pipe to said hydraulic supply to the first cylinder.

19. A multistaged telescope boom, in particular for a loading crane on a truck, where a hydraulic unit, comprising a piston (16) and a cylinder (9-12), is arranged between successive, telescopic arms (2-7), said boom comprising a hydraulic system connecting said hydraulic units for the operation thereof and arranged to force the hydraulic units of at least the two innermost arms for filling a cylinder chamber (27) of one of these cylinders at a time, starting from the innermost arm and moving outwardly in the order of the arms when extending the boom, and draining said cylinder chambers in the opposite order when retracting the boom, wherein at least the hydraulic unit of said innermost arm is provided with an arrangement structured and arranged to isolate the cylinder chamber (27) of that first cylinder from communication with said hydraulic system when that cylinder is fully extended, and re-establish said communication upon full retraction of the cylinder next to said first cylinder, and said arrangement comprises a first member (36) spring-biased into a position closing an exhaust opening of the cylinder chamber (27) of said first cylinder and a second member (42) structured and arranged to press said first member (36) out of said closing position for exhausting hydraulic fluid from the cylinder chamber through control by the hydraulic unit comprising said next cylinder depending upon the arrival of the next cylinder to the fully retracted state.

20. A telescope boom according to claim 19, wherein said first member (36) and exhaust opening are structured and arranged to gradually and/or step by step increase the cross section of a flow path from said cylinder chamber to the hydraulic system upon pressing by the second member (42) of the first member further away from said closing position.

21. A telescope boom according to claim 20, wherein said first member (36) and exhaust opening are structured and arranged upon moving of the first member (36) away from said closing position to first connect said cylinder chamber (27) with the hydraulic system through a first opening (43) with a small cross sections and when moved further through a second opening (44) with a substantially larger cross section.

22. A telescope boom according to claim 21, wherein there is a distance between said two openings (43, 44) resulting in a dead stroke of said first member upon connection through said first opening (43) before connection through said second opening (44).

23. A telescope boom according to claim 21, wherein said second member (42) has at least one opening arranged to participate in forming a flow path from the cylinder chamber (27) to said hydraulic system and said first and second openings (43, 44) are provided in said second member (42).

24. A telescope boom according to claim 19, wherein said second member (42) has at least one opening arranged to participate in forming a flow path from the cylinder chamber (27) to said hydraulic system.

25. A telescope boom according to claim 19, wherein said first cylinder comprises a piece (41) structured and arranged to be mechanically hit by a member (40) of the next cylinder in the end of a retraction movement thereof for causing said second member (42) to press said first member (36) out of said closing position.

26. A telescope boom according to claim 19, wherein said first cylinder and the next cylinder each comprise an inlet port (20) to the rear side of the respective piston (16) for connection to said hydraulic system for applying a hydraulic pressure upon the piston for retracting the respective cylinder, and said inlet ports are connected in series with the one belonging to the innermost cylinder before the one belonging to the next cylinder.

27. A telescope boom according to claim 19, wherein said first cylinder comprises a pipe (30) extending axially from a cylinder bottom (23) through the cylinder chamber (27) and into a hollow piston rod (17) of the hydraulic unit, the interior of the pipe is arranged to communicate with said hydraulic system, and said exhaust opening is arranged to connect said cylinder chamber (27) to the interior of the pipe for connection to the hydraulic system therethrough.

* * * * *